US005960517A

United States Patent [19]

Sprekeler

[11] Patent Number: 5,960,517

[45] Date of Patent: Oct. 5, 1999

[54] FIXING DEVICE FOR DOOR FURNITURE

[75] Inventor: Gunther Sprekeler, Tarragindi, Australia

[73] Assignee: Gainsborough Hardware Industries Limited, Blackburn, Australia

[21] Appl. No.: 08/894,905

[22] PCT Filed: Apr. 12, 1996

[86] PCT No.: PCT/AU96/00212

§ 371 Date: Dec. 3, 1997

§ 102(e) Date: Dec. 3, 1997

[87] PCT Pub. No.: WO96/32555

PCT Pub. Date: Oct. 17, 1996

[30] Foreign Application Priority Data

Apr. 13, 1995 [AU] Australia ..... PN2441
May 11, 1995 [AU] Australia ..... PN2904

[51] Int. Cl.[6] ..... B25G 1/00

[52] U.S. Cl. ..... 16/121; 292/357; 292/352; 16/114 R

[58] Field of Search ..... 16/24, 30, 40, 16/114 R, 121; 403/321, 324, 325, 328; 292/348, 352, 357, 347

[56] References Cited

U.S. PATENT DOCUMENTS 5,388,307 2/1995 Hyde ..... 16/121

FOREIGN PATENT DOCUMENTS

| | | | |
|---|---|---|---|
| 35314/50 | 8/1950 | Australia . | |
| 3310/61 | 4/1963 | Australia . | |
| 24969/77 | 11/1978 | Australia . | |
| B-90490/91 | 1/1991 | Australia | 292/357 |
| B-29140/92 | 11/1991 | Australia | 292/357 |
| 90490/91 | 7/1992 | Australia . | |
| 29140/92 | 5/1993 | Australia . | |
| 577552 | 5/1946 | United Kingdom . | |
| 1085059 | 9/1967 | United Kingdom . | |

*Primary Examiner*—Anthony Knight
*Assistant Examiner*—Agatha Youmans
*Attorney, Agent, or Firm*—Sughrue, Mion, Zinn, Macpeak & Seas, PLLC

[57] ABSTRACT

A fixing device for an item of door furniture such as a knob or handle includes a mounting plate assembly with an internal locking slide plate which engages, with a snap-action, fixing lugs carried by the knob or handle when the knob or handle is presented to the mounting plate assembly.

14 Claims, 2 Drawing Sheets

FIXING DEVICE FOR DOOR FURNITURE

Figure 1:
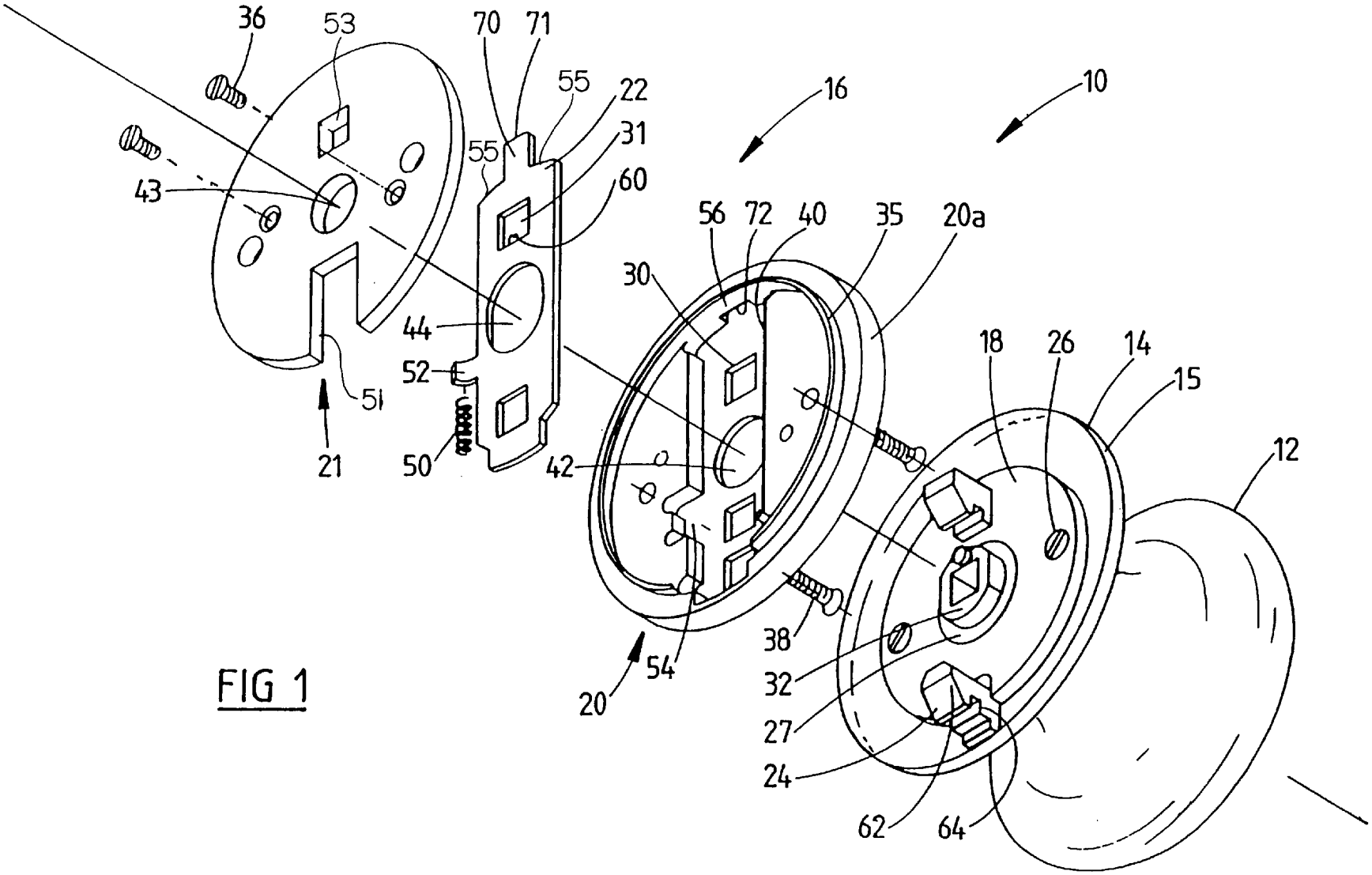

This invention relates generally to the fixing in place of door furniture such as knobs and handles.

A common arrangement for mounting locksets and latchsets to doors entails a pair of mounting plates which abut the respective faces of the door and are fastened together through the intervening cavity which would typically also house the latch or lock assembly. The associated knobs or handles are each attached to a backing plate which is threadably engaged onto the mounting plate. A common arrangement is for the mounting plate to have an outstanding externally threaded spigot and for the rosette to have a central spigot with a matching internal thread. This traditional form of concealed fixing has aesthetic advantages over earlier one-piece fixing plates in which mounting screws are exposed but requires care on attachment to avoid the risk of thread damage. There is also a problem with the backing plate, and therefore the knob or handle, working loose in time. The latter problem has been approached by providing lug or friction configurations to oppose the loosening motion but these of course add to the complexity of the construction.

International patent publication WO92/12314 proposes an alternative configuration in which a backing plate, and mounting plate are interengaged in a bayonet fixing arrangement. This arrangement still involves a rotary attachment motion and remains susceptible to disengagement, especially bearing in mind that the knob or handle repeatedly functions with a rotary motion.

It is an object of the present invention to provide a novel fixing device for door furniture such as knobs or handles which is adaptable to a concealed fixing but eliminates the rotary action necessary in prior concealed fixing arrangements.

According to one aspect of the invention, there is provided a fixing device for door furniture comprising, a mounting plate assembly adapted for fastening to a door, the mounting plate assembly including slide means for sliding movement generally parallel to the door, when in situ, between a locking position and an attachment position, means to bias the slide means to the locking position, and an opening in the slide means to receive a fixing lug of an item of door furniture, said lug being configured for moving the slide means from the locking position to the attachment position on application of the lug to the opening, and for being thereafter locked into the mounting plate assembly on return of the slide means to its locking position whereby to attach the item of door furniture to the mounting plate assembly.

According to another aspect of the invention, there is provided a handle or knob assembly for a door comprising:

a mounting plate assembly adapted for fastening to a door, the mounting plate assembly including slide means for sliding movement generally parallel to the door, when in situ, between a locking position and an attachment position, means to bias the slide means to the locking position, and complementary openings in an outer face of the mounting plate assembly and in the slide means; and an item of door furniture including a handle or knob carrying lugs complementary to said openings for receipt by the openings, wherein said lugs are configured for moving the slide means from the locking position to the attachment position on application of the lugs to the openings, and for being thereafter locked into the mounting plate assembly on return of the slide means to its locking position to thereby attach the item of door furniture to the mounting plate assembly.

In an embodiment, the mounting plate assembly may comprise a pair of disc members defining a guideway in which the slide means is slidable. The slide means is preferably an elongate plate which extends generally transversely of the disc members, and the guide means is advantageously a matching slot for this plate in one of the disc members.

In another embodiment, the mounting plate assembly comprises a pair of plates spaced to slidably receive the slide means, which is then preferably a further plate. All three plates may be elongated.

The slide means preferably includes a portion exposed for engagement by a tool to move the slide means against the biasing means from the locking position to the attachment position, to permit detachment of the lugs and therefore the door furniture item from the mounting plate assembly.

The mounting plate assembly, for example both disc members and the slide plate in a preferred embodiment, may carry apertures to receive a knob spindle or spigot for operating an associated latch mechanism.

In another embodiment, the mounting plate assembly includes a releasable snib mechanism and may constitute a so-called privacy adapter for an associated latch mechanism.

The openings in the slide means are preferably at least partially rectangular to define an edge which is acted upon by a tapered portion of the associated lug, for moving the slide means from the locking position to the attachment position, and for receipt in a complementary groove of the lug to complete a snap-action locking engagement.

Preferably, there are two pairs of complementary openings in the mounting plate assembly and slide means, and an associated pair of lugs.

In one arrangement, the lugs are carried by a backing plate which may be attached to the rear face of, and within the rim of, a rose or rosette which may in turn carry a knob or handle in a rotary engagement maintained, eg, by a circlip or like device. In another arrangement, the lugs are directly secured to an escutcheon or cover plate which also rotatably mounts a knob or handle.

According to yet another aspect of the invention, there is provided a handle or knob assembly for a door comprising an item of door furniture including a handle or knob and at least one projecting fixing lug, and a mounting plate assembly securable relative to the door and including a resilient locking device which engages the lug with a snap-action when the item of door furniture is presented to the mounting plate assembly whereby to retain the item of door furniture to the mounting assembly.

Figure 2:
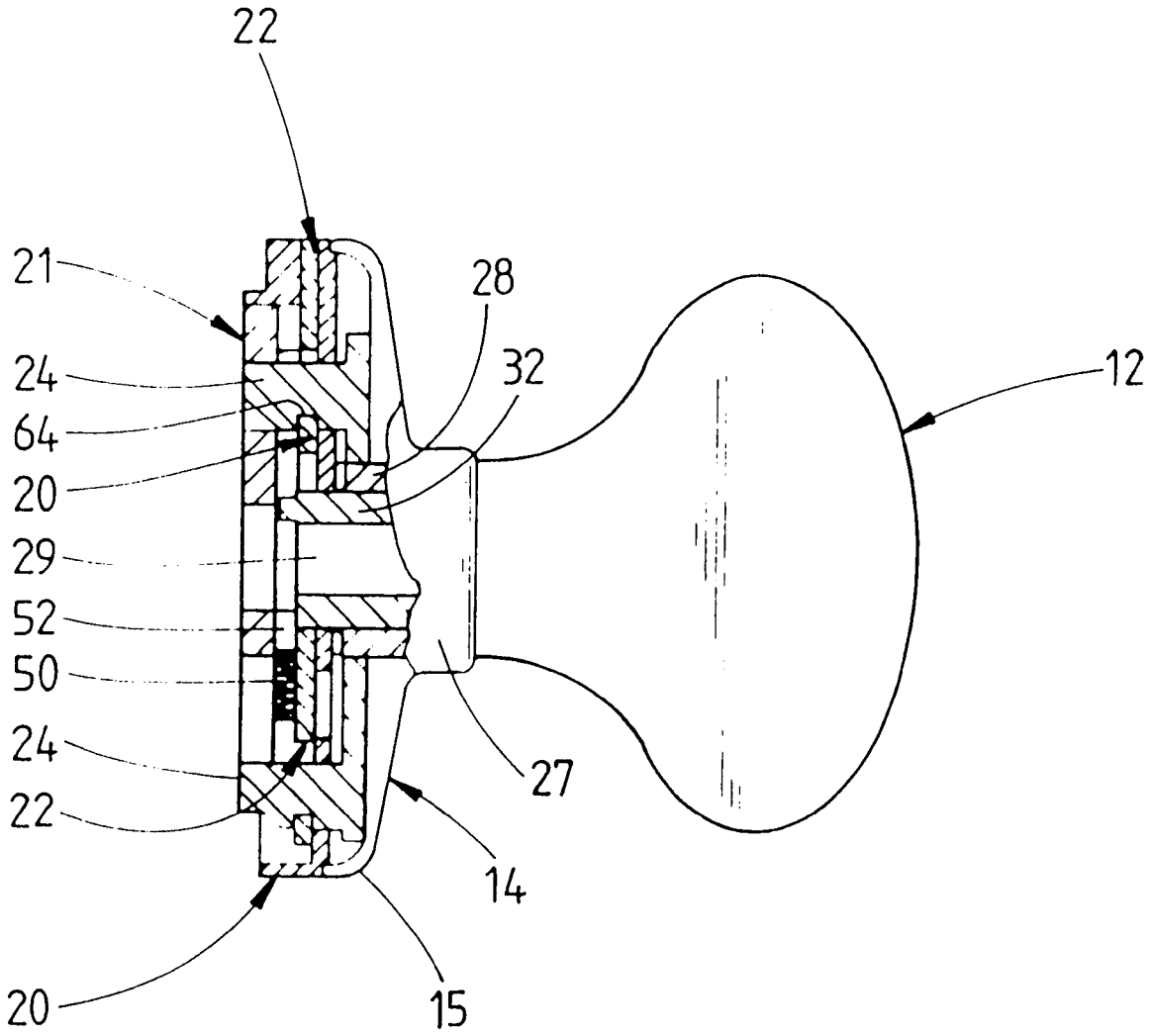

The invention will now be further described, by way of example only, with reference to the accompanying drawings, in which:

FIG. 1 is an exploded isometric view of a single complete knob set according to an embodiment of the invention; and FIG. 2 is a sectioned view of the assembled knob set.

The illustrated knob set 10 includes a knob 12 with an associated rosette 14, and a mounting plate assembly 16 which is attached to the door by fastening to the door surface and/or to a similar mounting plate assembly on the other side of the door. Rosette 14 carries a backing plate or disc 18 within its rim 15, while mounting plate assembly 16 is formed of respective disc portions 20,21 and an internal diametrally mounted slide plate 22. A pair of profiled lugs 24 projecting rearwardly from backing plate 18 engage matching rectangular openings 30,31 in disc member 20 and slide plate 22 in a snap action fixing with the slide plate 22 whereby the assembly of the knob and its mounting plate and rosette may be attached to the mounting plate assembly after it has been secured to a door.

Backing plate 18 is fastened to the rear surface of rosette 14 by means of screws 26. These are not visible from in front of the knob. The rosette includes a central outstanding flange 27 which receives the rear of the knob 12. An internal central bearing portion 28 of the rosette is rotatably engaged on a rearwardly projecting spigot 32 of the knob with a circlip or other similar device. Spigot 32 has a square section bore 29 to receive one end of the operating spindle typical of latch sets and lock sets.

Disc portion 20 is somewhat thicker than disc portion 21 and receives the latter, which is of smaller radius, within an annular seating flange 35, the two being fastened together from behind disc 21 by screws 36. In situ, disc 21 is at the rear and the mounting plate assembly is typically fastened to a similar assembly at the other side of the door by means of long screws or bolts such as 38 which extend through an associated cavity in the door.

Disc portion 20 also has a diametrally extending slot 40 in which locking plate 22 is a close sliding fit. The disc portions 20,21 and plate 22 have matching central apertures 42,43,44 to receive spigot 32 and the drive spindle: aperture 44 must of course be elongated slightly to accommodate the diametral sliding motion of plate 22.

Plate 22 has a pair of rectangular, in this case, square openings 31 to either side of the axis of the system which generally match with a pair of similar openings 30 in disc member 20 and with a radial slot 51 and opening 53 in disc member 21. The plate 22 is biased by a heavily compressed helical tension spring 50, which acts on a lateral lug 52 in a side recess 54 of slot 40, to a locking position defined by abutment of end shoulders 55 of plate 22 with an interior rim surface 56 of disc portion 20 at one end of slot 40. A similar engagement occurs at the other end of the slot, and defines the attachment position of plate 22. In this attachment position, the holes 30,31 are substantially an exact register, whereas in the locking position, they are offset so that an edge of each opening 31 lies across opening 30.

Lugs 24 are configured in their lateral dimensions to fit comfortably through openings 30,31 but at one forward corner edge they are truncated to provide an oblique face 62. When plate 22 is in its locking position and the knob 12 is used to push lugs 24 into openings 30, this oblique face 62 acts on edges 60 of openings 31 to push plate 22 along slot 40 against spring 50 until the lugs can pass fully through the openings 31. The dimensions are such that on slight further forward motion of the lugs through the openings, the edges 60 of openings 31 snap into matching transverse slots 64 in lugs 24, thus locking the assembly of the knob 12, rose 14 and backing plate 18 onto the mounting plate assembly 16.

It will be appreciated that the illustrated knob set would normally be supplied in two parts, with the mounting plate assembly as a unit and the knob with its rosette 14 and backing plate 18 as a further unit. The installer would fix the latch and/or lock mechanism in the door cavity and then fasten the two mounting plate assemblies 16 into place over the cavity at the respective sides of the door, using bolts such as 38. The respective knobs could then be readily attached by bringing the lugs 24 up to the respective openings 30 in the mounting plate assemblies and snap fastening them into position in the manner described above.

To allow for detachment of the knob, slide locking plate 22 has an end tab portion 70 which projects through a complementary aperture 72 in the rim of disc portion 20 so that its tip 71 is exposed flush with the outer cylindrical surface 28 of disc portion 20. The fixing can be disassembled by applying a tool such as a screwdriver to the tip 71 to push the slide plate 22 against spring 50 until openings 31 are aligned with openings 30 and the lugs 24 can be extracted and the knob thereby detached.

In a further embodiment (not illustrated), especially suitable for long-plate fixings, the mounting plate assembly is a pair of flat plates held apart, for example by spacer sleeves about screws fastening the plates together, to define a space in which the slide plate is slidable. Pairs of rectangular openings in the assembly plates and a complementary pair of slots in the slide plate are arranged to receive lugs for snap engagement as in the illustrated embodiment.

In yet a further embodiment the mounting plate assembly may also include a releasable snib mechanism for selectively preventing operation of an associated latch mechanism from one or both sides of the door. In this form the mounting plate assembly may constitute a so-called privacy adapter which can be substituted for a mounting plate assembly without this facility, at the choice of the installer. One suitable form of privacy adapter is described in our International patent application PCT/AU92/00609 (WO93/10324).

Instead of a helical tension spring biasing the slide plate by pushing it to the locking position, a helical compression spring may be employed to draw the slide plate to the locking position.

Lugs 24 may of course be separately attached to the rosette or other escutcheon or cover plate 14. For example, with a long plate fitting, each lug may be part of a separate integral T-piece which is riveted to the back of the elongated escutcheon or cover plate in which the knob or handle is journalled or otherwise rotatably mounted.

Throughout this specification, unless the context requires otherwise, the word "comprise", or variations such as "comprises" or "comprising", will be understood to imply the inclusion of a stated integer or group of integers but not the exclusion of any other integer or group of integers.

The described arrangement has been advanced merely by way of explanation and many modifications may be made thereto without departing from the spirit and scope of the invention which includes every novel feature and combination of novel features herein disclosed.

I claim:

1. A fixing device for door furniture comprising:

a mounting plate assembly adapted for fastening to a door, the mounting plate assembly including slide means for sliding movement generally parallel to the door, when in situ, between a locking position and an attachment position, means to bias the slide means to the locking position, and an opening in the slide means to receive a fixing lug of an item of door furniture, said lug being configured for moving the slide means from the locking position to the attachment position on application of the lug to the opening, and for being thereafter locked into the mounting plate assembly on return of the slide means to its locking position whereby to attach the item of door furniture to the mounting plate assembly.

2. A fixing device according to claim 1, wherein the slide means is adapted to receive a plurality of said fixing lugs on the item of door furniture with a snap action upon presentation of the item to the mounting plate assembly in a direction substantially perpendicular to the door.

3. A fixing device according to claim 1, wherein the slide means includes a portion accessible to an external tool when the item of door furniture is attached to the mounting plate assembly whereby said slide means is able to be moved by the tool to its attachment position by said tool to thereby permit detachment of the item of door furniture from the mounting plate assembly.

4. A handle or knob assembly for a door comprising:

a mounting plate assembly adapted for fastening to a door, the mounting plate assembly including slide means for sliding movement generally parallel to the door, when in situ, between a locking position and an attachment position, means to bias the slide means to the locking position, and a complementary opening in an outer face of the mounting plate assembly and in the slide means; and an item of door furniture including a handle or knob carrying lug complementary to said opening for receipt by the opening, wherein said lug is configured for moving the slide means from the locking position to the attachment position on application of the lug to the opening, and for being thereafter locked into the mounting plate assembly on return of the slide means to its locking position to thereby attach the item of door furniture to the mounting plate assembly.

5. A handle or knob assembly according to claim 4, wherein the item of door furniture includes a plurality of said handle or knob carrying lugs complementary to a plurality of said openings in the mounting plate assembly and the slide means.

6. A handle or knob assembly according to claim 4, wherein the mounting plate assembly comprises first and second opposed plates, and the slide means comprises a third plate guided for movement between the opposed plates parallel to the opposed plates.

7. A handle or knob assembly according to claim 5, wherein the first and second plates comprise disc members.

8. A handle or knob assembly according to claim 6, wherein one of said disc members includes a slot which defines a guideway for the sliding movement of the third plate.

9. A handle or knob assembly according to claim 4, wherein the mounting plate assembly includes a releasable snib mechanism for selectively preventing operation of an associated latch mechanism by operation of a respective handle or knob at one or both sides of the door.

10. A handle or knob assembly according to claim 4, wherein the slide means includes a portion exposed for engagement by a tool to move the slide means against the biasing means from the locking position to the attachment position, to permit detachment of the lug and therefore the item of door furniture from the mounting plate assembly.

11. A handle or knob assembly according to claim 4, wherein the mounting plate assembly includes an aperture for passage of a drive member for operating an associated latch mechanism.

12. A handle or knob assembly according to claim 4, wherein the openings in the slide means define an edge which is acted upon by a tapered portion of the associated lug, for moving the slide means from the locking position to the attachment position, and for receipt in a complementary groove of the lug to complete a snap-action locking engagement.

13. A handle or knob assembly according to claim 4, wherein the lug is carried by a backing plate secured to the item of door furniture.

14. A handle or knob assembly according to claim 4, wherein the lug is directly secured to an escutcheon plate or cover plate of said item of door furniture.

* * * * *